United States Patent [19]

Straitz, III

[11] 4,092,095

[45] May 30, 1978

[54] COMBUSTOR FOR WASTE GASES

[75] Inventor: John F. Straitz, III, Meadowbrook, Pa.

[73] Assignee: Combustion Unlimited Incorporated, Elkins Park, Pa.

[21] Appl. No.: 779,047

[22] Filed: Mar. 18, 1977

[51] Int. Cl.[2] ..... F23C 7/04

[52] U.S. Cl. ..... 431/114; 431/180; 431/202

[58] Field of Search ..... 431/202, 114, 180, 174, 431/175, 5, 182, 183; 23/277 C

[56] References Cited

U.S. PATENT DOCUMENTS

| | | | |
|---|---|---|---|
| 3,244,220 | 4/1966 | Kluecker | 431/175 X |
| 3,933,420 | 1/1976 | Zink et al. | 431/202 |
| 3,982,881 | 9/1976 | Schwartz et al. | 431/202 |
| 3,985,494 | 10/1976 | Childree | 431/175 |
| 3,995,986 | 12/1976 | Straitz | 431/114 |
| 4,009,989 | 3/1977 | Bitterlich | 431/178 |
| 4,029,469 | 6/1977 | Bitterlich | 431/114 |

*Primary Examiner*—Edward G. Favors
*Attorney, Agent, or Firm*—Zachary T. Wobensmith, 2nd; Zachary T. Wobensmith, III

[57] ABSTRACT

A combustor is described for use in populated areas which may be elevated, and mounted on the roof of a building or which may be mounted on the ground, the combustor being adapted for waste gas having a very low btu content, or is a very dirty gas containing tars and particulate material, or is a very low pressure gas which has insufficient kinetic energy to mix readily with air, an upright combustion chamber open at the top being employed surrounded by an acoustical fence to reduce transmission of noise from the combustion and from secondary air supplied over the fence to reduce wind effect, and to reduce light transmission from the combustion process, the burners being disposed beneath a radiation floor and being independent and separately removable for cleaning without shut down of the combustor.

10 Claims, 4 Drawing Figures

10
12
13
14
14a
15
16
17
20
21
22
23
24
25
26
27
28
40
41
42
43
44
45
46
47
48
50
51
56
58
71
11

COMBUSTOR FOR WASTE GASES

CROSS REFERENCE TO RELATED APPLICATION

In my application for Waste Gas Burners filed Mar. 15, 1977 Ser. No. 777,782 a burner is described which is suitable for burning waste gas and particularly coal gas. The present application embodies a specific use of such burners in a different setting and in populated areas.

BACKGROUND OF THE INVENTION

1. Field of the Invention

This invention relates to combustors for waste gas and more particularly to combustors for use in populated areas and either in an elevated position as on the roof of a building or on the ground.

2. Description of the Prior Art

It has heretofore been proposed to burn waste gas of various types and compositions.

It has also heretofore been proposed to utilize an upright combustion chamber with noise suppression including an acoustical fence.

None of the prior devices have been suited for use in populated areas not only because of the excessive noise but also because of excessive output of noxious or partly burned gases including $NO_x$ and because of the tendency of the burners to clog when certain types of gases were burned.

The present invention overcomes the shortcomings of the waste gas burners which are now available.

SUMMARY OF THE INVENTION

In accordance with the invention a combustor is provided for use in populated areas, which may be elevated as on the roof of a building or may be mounted on the ground, for burning waste gas having a very low btu content, or a very dirty gas containing tars and particulate material, or a very low pressure gas which has insufficient kinetic energy to mix readily with air, and which employs an upright combustion chamber open at the top and surrounded at the bottom by an acoustical and wind fence to reduce transmission of noise from the combustion and entry of secondary air for combustion and transmission of glare from the combustor, the burners being located beneath a radiation floor and being independent and separately removable for cleaning without shut down of the combustor.

It is the principal object of the invention to provide a combustor for waste gas which overcomes the objectionable features of the devices heretofore available.

It is a further object of the invention to provide a combustor for waste gas which can be used in populated areas because of the reduced noise and glare transmission and reduced release of noxious or unburned gases.

It is a further object of the invention to provide a combustor which is suited for continuous operation and which does not require shut down for burner change.

It is a further object of the invention to provide a combustor which is suitable for burning the combustible content of various waste gases.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

Figure 1:
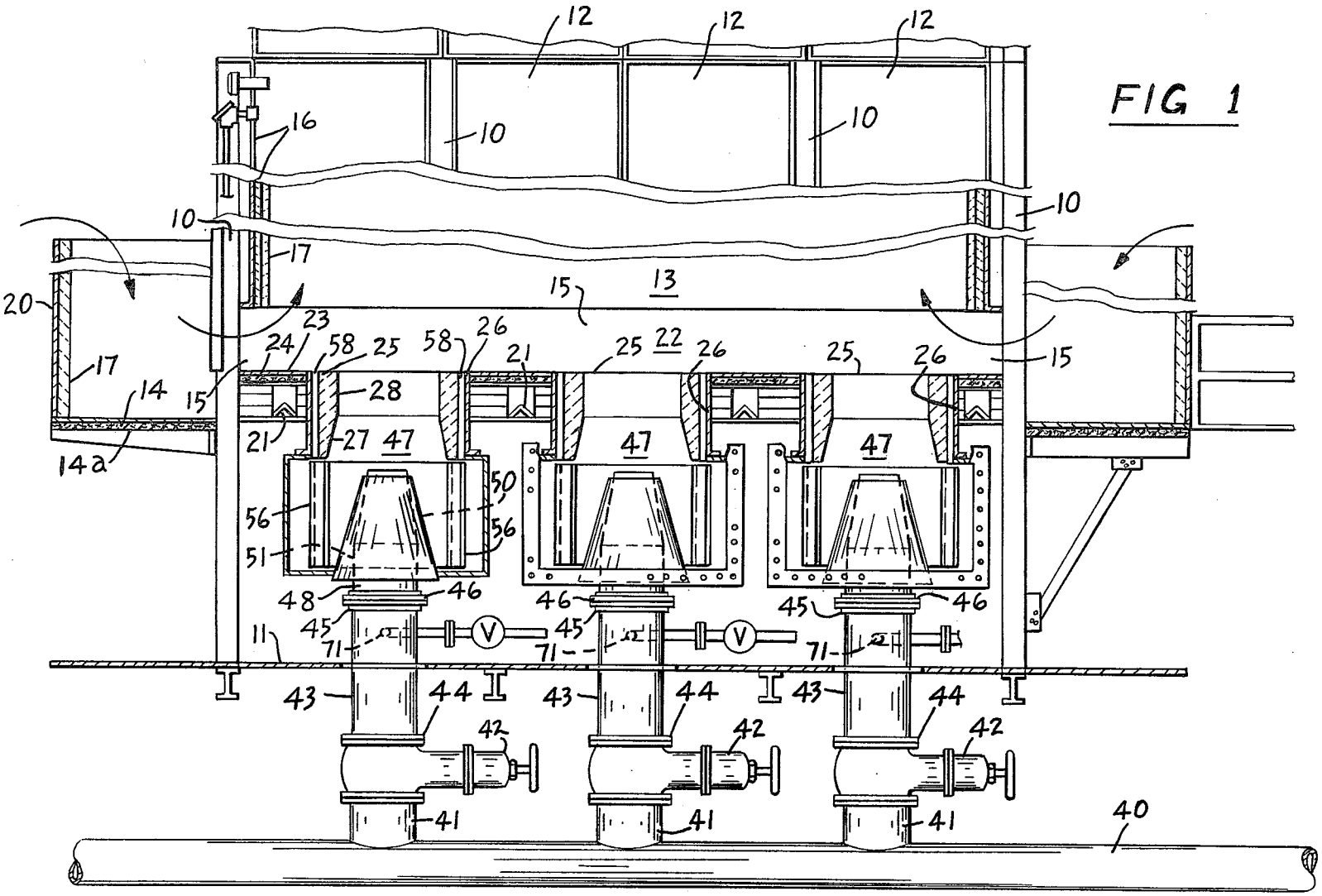
FIG. 1 is a view partly in elevation and partly in vertical section of a combustor in accordance with the invention.
Figure 2:
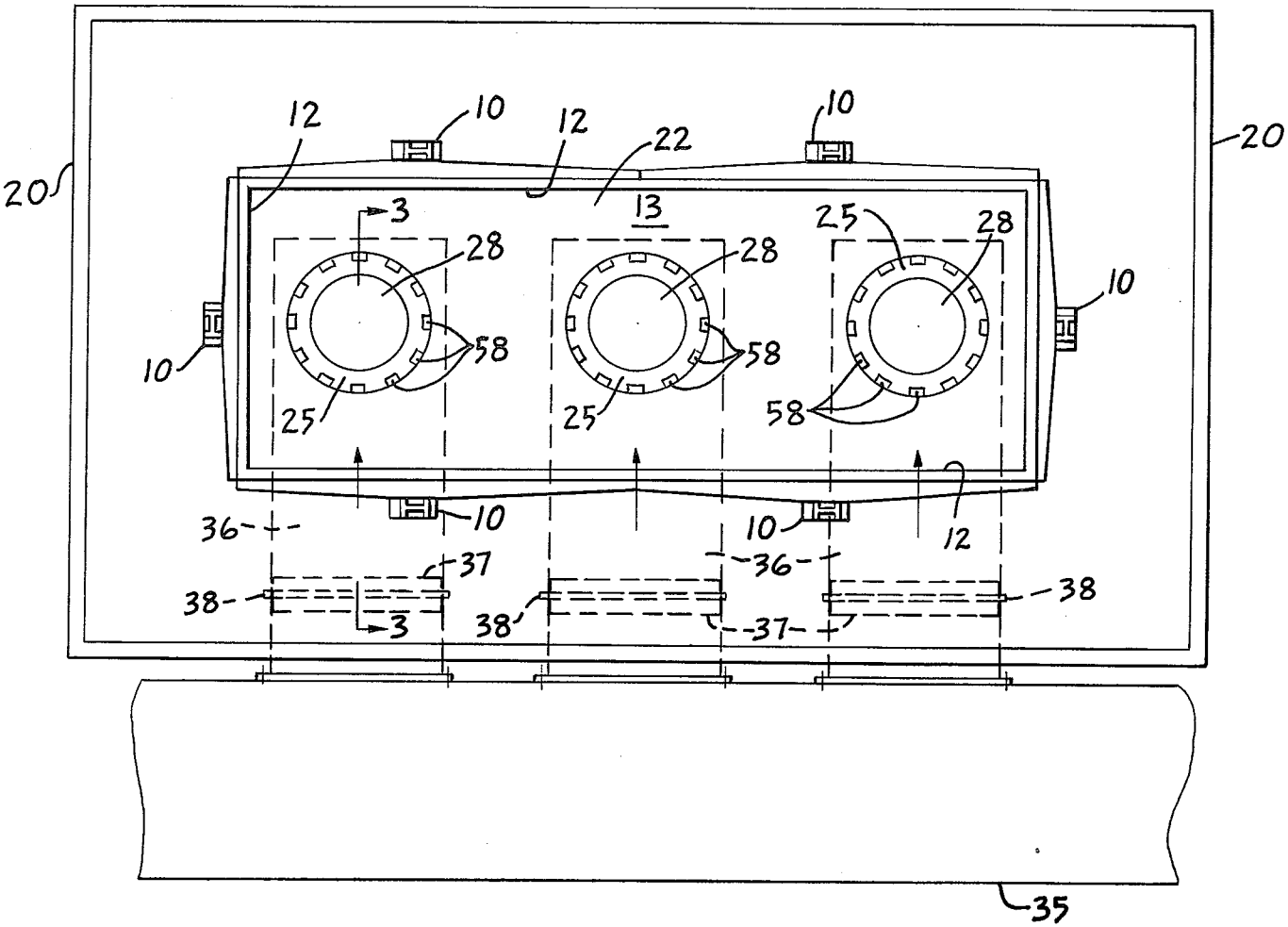
FIG. 2 is a fragmentary top plan view of the combustor shown in FIG. 1.
Figure 4:
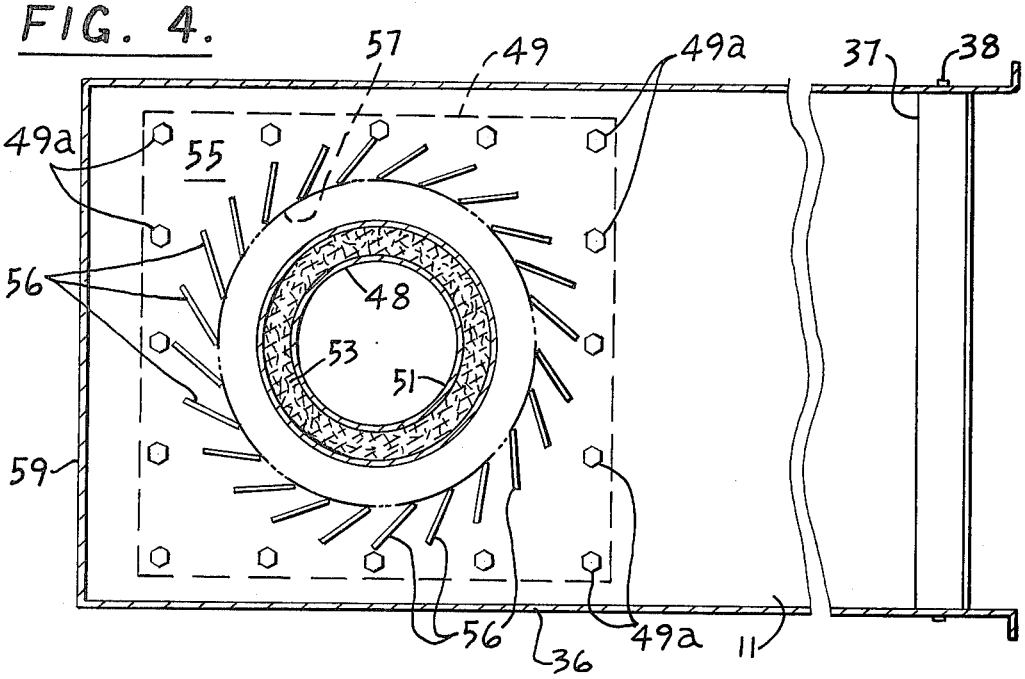
FIG. 4 is a horizontal sectional view taken approximately on the line 4—4 of FIG. 3.
Figure 3:
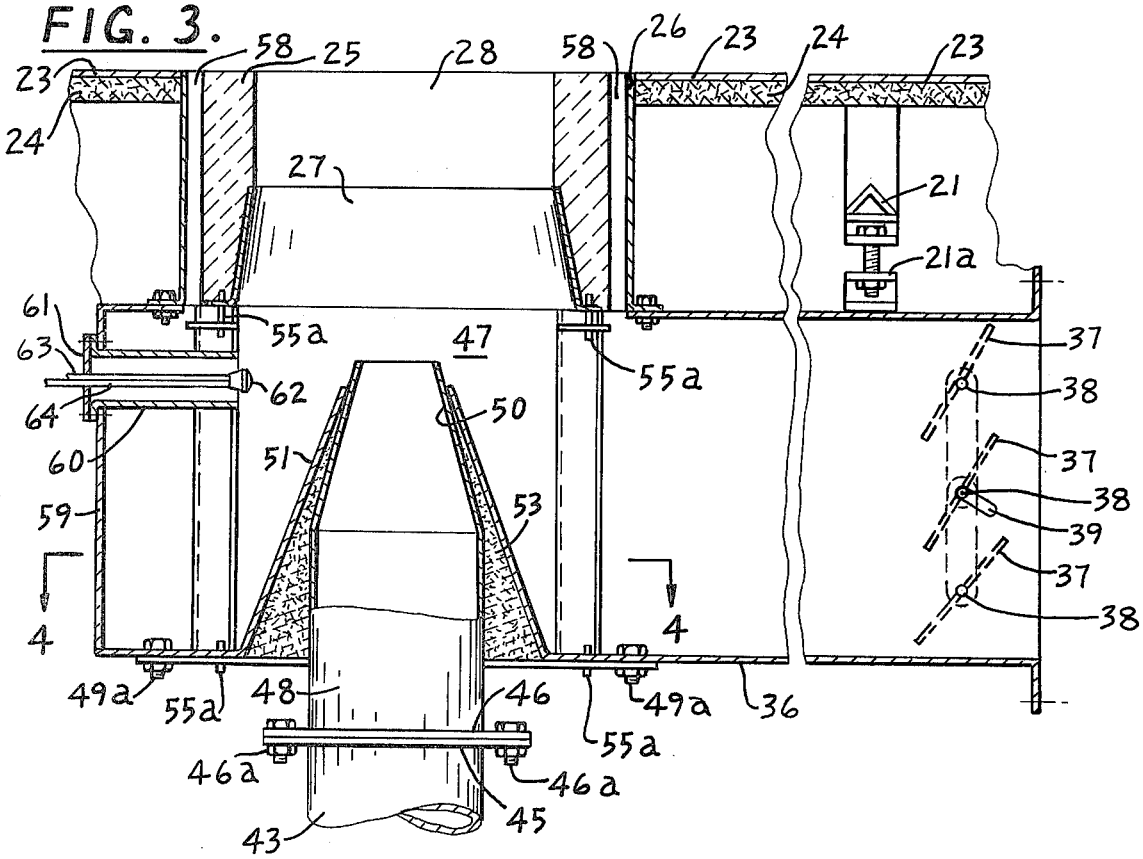
FIG. 3 is a vertical sectional view, enlarged, taken approximately on the line 3—3 of FIG. 2.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF A PREFERRED EMBODIMENT

Referring now more particularly to the drawings, in which a preferred embodiment of the invention is illustrated an upright frame 10 braced in any suitable manner is provided shown as extending vertically upwardly from a roof 11.

A plurality of vertical wall panels 12 carried by the frame 10 extend downwardly from the top thereof to provide a rectangular combustion chamber 13. An exterior platform 14 is provided spaced above the roof 11 and the wall panels 12 terminate in spaced relation above the platform 14 to provide air access openings 15. The platform 14 has therebelow a glass fiber blanket **14*a*** to reduce noise transmission.

The wall panels 12 may be of any desired light weight construction and preferably comprise outer metal plates 16 connected at their meeting edges and with an insulating lining of heat resistant ceramic fiber blanketing 17 with rigidizers to retain the blanketing in position.

One suitable lining material is available under the name KAOWOOL from Babcock & Wilcox Company, New York, New York and consists of a stable high temperature alumina silica ceramic fibrous sheet.

The walls 12 greatly reduce the transmission of heat from the combustion and also greatly reduce transmission of sound attendant on combustion.

The platform 14 has around the periphery thereof a wind and heat shielding acoustical fence 20 which extends vertically above the lower margins of the wall panels 12 a sufficient distance to prevent transmission of sound and glare attendant upon combustion and the sound attendant upon the entry of air over the fence 20 and through the access openings 15. The fence 20 has a ceramic fiber lining similar to that of the combustion chamber 13.

At the level of the platform 14 interior framing 21 is provided which supports a metallic heat shield 22 comprising metal plates 23 with ceramic fibrous insulation 24 therebelow.

The framing 21 and heat shield 22 have extending therethrough a plurality of ceramic refractory burner blocks 25 contained within outer metallic shells 26, the burner blocks 25 having lower converging frusto-conical openings 27 and upper cylindrical openings 28.

A main air supply header 35 is provided removably supported by hangers **21*a* from the framing 21 for delivery of primary air under pressure from which horizontal branch ducts 36 extend beneath the framing 21 and platform 14 and the burner blocks 25. Each of the branch ducts 36 has damper vanes 37 on shafts 38 and manually operable for closing if the air is to be shut off at selected branch ducts 36 a common control handle 39** being employed.

A waste gas supply pipe 40 is provided preferably disposed below the roof 11 with branch lines 41 extending therefrom and with manually operable gate valves 42 for controlling waste gas flow. Connectors 43 with flanges 44 detachably connected to the gate valves 45 have flanges 45 detachably connected to flanges 46 by the bolts 46*a*. The burner nozzles 47 are in axial alignment with the burner blocks 25.

The burner nozzles 47 each has an interior burner pipe 48 extending upwardly from a mounting plate 49 detachably carried by bolts 49*a* on the branch ducts 36. The burner nozzle pipes 48 each has a converging frusto-conical portion 50 to increase the discharge velocity of the gas.

Each of the burner nozzle pipes 48 has an exterior frusto-conical wall or flow cone 51 to direct air in the duct branch to and through the burner block openings 27 and 28 with the space between the wall 48 and the wall 51 being filled with a heat insulating material 53 preferably of a stable high temperature alumina silica ceramic fibrous material of a density of the order of 3 pounds per cubic foot to retain heat in the interior wall 48. The burner nozzles 47, mounted on the frame plates 49 are also detachable connected to the connectors 43.

The burner nozzles 47, in surrounding relation thereto, and spaced outwardly therefrom, and within the ducts 36, are each provided with an air vane assembly 55 positioned by positioning pins 55*a* comprising spaced fixed vanes 56. The vanes 56 can be disposed at an angle of about 15° to an inner construction cylinder 57. For a specific embodiment and for a shell diameter of about 3 feet 24 vanes with 1 inch gaps can be employed.

The refractory block 25 has a plurality of air passageways 58, preferably equally spaced and bounded by the shell 26, in communication with the ducts 36 and with the combustion space beyond the burner block 25 for delivery of secondary air downstream of the combustion. In a specific embodiment twelve equally spaced openings or passageways 58 can be employed with a total area of the order of 90 square inches.

The terminal end walls 59 of the air ducts 11 are spaced from the air vane assemblies 55 to provide free access of air to the vane assemblies 55 and is preferably each provided with a tubular mounting 60 which is closed at its outer end by a wall 61. A gas pilot nozzle 62 is carried on a gas supply pipe 63 which extends through the wall 59. The gas pilot nozzle 62 can be of any desired type, one suitable nozzle being that shown in U.S. Pat. No. 3,463,602 to Gordon M. Bitterlich. An igniter pipe 64 is preferably also provided for delivery of an igniter flame for igniting the gas from the pilot nozzle 62.

Each of the connectors 43 has a gas pipe 71 for introduction of assist gas of high btu content with a detachable connection 72 and control valve 73 for use where the gas content of the waste is too low in heating value for effective combustion.

It will be noted that access is available to the gate valves 42 for shut-off if desired, and that the connectors 43 are detachably connected to the gate valves 42. If the mounting plates 49 are detached, and the connector 43 removed the burner nozzles 47 can be removed for inspection and replaced if necessary. Continued operation is available for one or more of the other burner nozzles.

The mode of operation will now be pointed out.

Assuming that waste gas is to be burned which may be gas having a very low btu content or is a very dirty gas containing tars and particulate material, or which is a very low pressure gas which has insufficient kinetic energy to mix readily with air, the waste gas is supplied to the waste gas supply pipe 40 and through one of the valves 42 in open position to a connector 43 and advanced through the burner nozzle 47.

In the customary operation, one or two of the burner nozzles 47, where three burner nozzles 47 are installed, are shut off by closing the gate valves 42 for standby operation.

It will be noted that the interior of the burner nozzle 25 is relatively open and substantially unobstructed to reduce the tendency for tar or carbonaceous material to collect therein. The converging wall portion 50 imparts an increase in velocity to the waste gas which further reduces the tendency for undesired collection of material within the burner nozzle 47.

Air supplied under pressure to the air supply header 35, and to the branch ducts 36, is controlled by the positioning of the damper vanes 37 which may be in open positions for delivery to the desired burner nozzle 47 and in closed positions to shut-off delivery. The air in the branch duct 36 to which it is supplied passes between the vanes 56 of the air vane assembly 55 in a swirling pattern to and along the outer wall of the flow cones 51 and into contact with the waste gas advancing through the burner nozzle 25 for admixture therewith and for combustion within and beyond the opening 38. The amount of air supplied in a swirling and spiralling pattern through the air vane assembly 55 as primary air is just about sufficient or slightly insufficient to complete combustion but is preferably at a velocity to assist the discharge of waste gas from the burner nozzle 47. The regulation of the amount of primary air in this manner causes a reduction in temperature of the combustion zone and by this temperature reduction reduces the $NO_x$ formation.

At the same time, to reduce the fall out or condensation of tars within the burner nozzle 25 or immediately therebeyond, the insulation of the interior wall portion 48 prevents undesired cooling by advancing primary air around the flow cone 51. The interior wall 48 heated by the combustion therebeyond retains its heat.

If the waste gas is of low velocity or of low kinetic energy or of low btu content combustible gas supplied through the pipe 71 may be employed to act as a booster.

Secondary air for combustion beyond the burner block 25 advances from the branch air duct 36 through the secondary air passageways 58 into contact with the burning gas from the burner block 25 beyond the burner block 25.

Additional secondary air is available to the combustion space, induced by the upwardly moving stream of burning material from above the acoustical fence 20 and through the openings 15.

The effecting of the initial combustion with reduced air and at a reduced temperature reduces the production of $NO_x$ but the completion of combustion with secondary air as herein provided still permits of complete combustion of the combustibles in the waste gas.

The noise of the combustion in the combustion chamber 13 and of the entry of secondary air through the openings 15 is effectively screened by the fence 20 and the walls of the combustion chamber 13, the noise being directed upwardly with a minimum of sidewise transmission.

The shielding of the bottom of the combustion chamber 13 permits of installation upon the roof of a building and is particularly useful where ground space is limited or unavailable at the location where the waste gas is to be burned.

If during operation, the burner nozzle 47 which is in use has a tendency to clog, operation of another burner nozzle 47 can be initiated and continued and the first mentioned nozzle 47 shut down, the connector 43 for that nozzle removed and that burner nozzle 47 removed for inspection and cleaning.

The provision of a plurality of separately removable burner nozzles 47 operated in the manner mentioned permits of continuity of operation of the combustor over an extended period of time.

I claim:

1. Apparatus for the combustion of waste gases which comprises, a combustion chamber bounded by vertical walls and open at the top and having openings at the bottom of the vertical walls for entry of air, said combustion chamber having a bottom closure, an acoustical fence surrounding said combustion chamber at the bottom thereof and spaced from said vertical walls for entry of air for combustion through said openings, said bottom closure having a plurality of burner blocks extending therethrough with vertical openings in the burner blocks for burning waste gas, waste gas burners disposed below and concentric with each of said burner blocks, a waste gas supply connection, valve members for controlling the supply of waste gas from said supply connection to each of said waste gas burners, a supply connection for air under pressure, branch ducts for each of said waste gas burners connected to said air supply connection for supplying primary air for combustion to each of said waste gas burners, members for controlling the flow through each of said ducts, each of said waste gas burners being removably mounted with respect to its burner block and its branch duct for inspection and cleaning.

2. Apparatus for the combustion of waste gases as defined in claim 1 in which said bottom closure has a heat shield comprising a metallic sheet with insulating material therebelow.

3. Apparatus for the combustion of waste gas as defined in claim 2 in which said combustion chamber is mounted on the roof of a building, said shield is in spaced relation to the roof of the building.

4. Apparatus for the combustion of waste gas as defined in claim 1 in which said waste gas burners are mounted in said branch ducts, and members are provided for delivering air from each of said ducts to and around the burner therein with a rotary motion for advance through the associated burner block and to said combustion chamber.

5. Apparatus for the combustion of waste gas as defined in claim 4 in which said waste gas burner has insulating material therein for preventing cooling of the gas by the air.

6. Apparatus for the combustion of waste gas as defined in claim 1 in which a booster gas supply connection is provided for assisting in the combustion of the waste gas delivered through said waste gas burner.

7. Apparatus for the combustion of waste gas as defined in claim 1 in which each of said waste gas supply connections includes a connector pipe removably inserted between the waste gas burner and its associated valve member.

8. Apparatus for the combustion of waste gas as defined in claim 1 in which each of said waste gas burners is removably mounted with respect to its associated branch duct.

9. Apparatus for the combustion of waste gas as defined in claim 1 in which each of said burner blocks has secondary air passageways communicating with its associated branch duct and with the combustion chamber beyond the burner block.

10. Apparatus for the combustion of waste gas as defined in claim 1 in which each of said waste gas burners has a central opening for substantially unobstructed flow of gas for combustion.

* * * * *